US010561577B2

(12) United States Patent
Shinoda

(10) Patent No.: US 10,561,577 B2
(45) Date of Patent: Feb. 18, 2020

(54) EYE-WASHING VESSEL

(71) Applicant: KOBAYASHI PHARMACEUTICAL CO., LTD., Osaka-Shi, Osaka (JP)

(72) Inventor: Tetsuhiro Shinoda, Osaka (JP)

(73) Assignee: KOBAYASHI PHARMACEUTICAL CO., LTD., Osaka-Shi, Osaka (JP)

( * ) Notice: Subject to any disclaimer, the term of this patent is extended or adjusted under 35 U.S.C. 154(b) by 0 days.

(21) Appl. No.: 16/085,548

(22) PCT Filed: Mar. 17, 2017

(86) PCT No.: PCT/JP2017/010916
§ 371 (c)(1),
(2) Date: Sep. 14, 2018

(87) PCT Pub. No.: WO2017/159850
PCT Pub. Date: Sep. 21, 2017

(65) Prior Publication Data

US 2019/0091101 A1 Mar. 28, 2019

(30) Foreign Application Priority Data

Mar. 17, 2016 (JP) ..... 2016-053572

(51) Int. Cl.
*A61H 35/02* (2006.01)

(52) U.S. Cl.
CPC ..... *A61H 35/02* (2013.01)

(58) Field of Classification Search
CPC ..... A61H 35/02
USPC ..... 4/620
See application file for complete search history.

(56) References Cited

U.S. PATENT DOCUMENTS

2008/0281045 A1 11/2008 Zhang
2015/0152256 A1 6/2015 Nakazawa et al.

FOREIGN PATENT DOCUMENTS

| | | | |
|---|---|---|---|
| CN | 101679706 | A | 3/2010 |
| CN | 104350103 | A | 2/2015 |
| EP | 2 862 897 | A1 | 4/2015 |
| JP | H06-184355 | A | 7/1994 |
| JP | 2006-020878 | A | 1/2006 |
| JP | 2008-061787 | A | 3/2008 |

(Continued)

OTHER PUBLICATIONS

International Search Report for International Application No. PCT/JP2017/010916, dated Apr. 18, 2017.

(Continued)

*Primary Examiner* — Tuan N Nguyen
(74) *Attorney, Agent, or Firm* — Wolf, Greenfield & Sacks, P.C.

(57) ABSTRACT

An object of the invention is to provide an eye-washing vessel capable of preventing or reducing damage to the vessel body and providing an improved fit of an eye-contacting portion to a portion around the eye. An eye-washing vessel (1) includes a vessel body (10) capable of containing an eyewash solution, and an eye-contacting portion (20) connected to the vessel body (10). The vessel body (10) has a bottom wall (12) and a peripheral wall (14), and the eye-contacting portion (20) is connected to an end of the peripheral wall (14) opposite to the bottom wall (12) side. The vessel body (10) is made of a vessel-body material including polyethylene, and the eye-contacting portion (20) is made of an eye-contacting portion material including polyethylene and a thermoplastic elastomer having a lower hardness than that of the polyethylene.

4 Claims, 2 Drawing Sheets

(56) References Cited

FOREIGN PATENT DOCUMENTS

| | | | |
|---|---|---|---|
| JP | 4495807 | B | 7/2010 |
| JP | 2010-527388 | A | 8/2010 |
| JP | 2014-057624 | A | 4/2014 |
| JP | 2014-057782 | A | 4/2014 |
| JP | 2016-029157 | A | 3/2016 |
| WO | WO 2008/029784 | A1 | 3/2008 |
| WO | WO 2008/141029 | A2 | 11/2008 |
| WO | WO 2013/187455 | A1 | 12/2013 |
| WO | WO 2014/042210 | A1 | 3/2014 |
| WO | WO 2016/006694 | A1 | 1/2016 |

OTHER PUBLICATIONS

Written Opinion for International Application No. PCT/JP2017/010916, dated Apr. 18, 2017.

Fig. 2

| | Materials for Eye-Washing Vessel | | | Results of Evaluation | | |
|---|---|---|---|---|---|---|
| | Vessel-Body Material | Eye-contacting Portion Material | Hardness Ratio | Falling Test | Adhesion | Transparency of Vessel Body |
| Example 1 | LDPE | Material A | 1.125 | ○ | ○ | △ |
| Example 2 | HDPE | Material A | 1.875 | ○ | ○ | △ |
| Example 3 | LDPE + EVA (8:2) | Material A | 1.1 | ○ | ○ | ○ |
| Example 4 | LDPE + EVA (5:5) | Material A | 1.075 | ○ | ○ | ◎ |
| Comparative Example 1 | PP | Material B | 2.75 | × | ○ | ◎ |
| Comparative Example 2 | PP | Material A | 2.75 | × | × | ◎ |
| Comparative Example 3 | LDPE | Material B | 1.125 | ○ | × | △ |

EYE-WASHING VESSEL

This Application is a national stage filing under 35 U.S.C. 371 of International Patent Application No. PCT/JP2017/010916, filed Mar. 17, 2017, which claims priority to Japanese Application No. JP 2016-053572, filed Mar. 17, 2016. The entire contents of each of these applications are incorporated herein by reference in their entirety.

TECHNICAL FIELD

The present invention relates to an eye-washing vessel used for washing eyes with an eyewash solution.

BACKGROUND ART

Eye-washing vessels used for washing eyes with an eyewash solution are conventionally known. For example, Patent Document 1 discloses an eye-washing vessel having a vessel body capable of containing an eyewash solution and an eye-contacting portion connected to the vessel body wherein the eye-contacting portion is to be fitted to a portion around an eye. The vessel body has a bottom wall and a peripheral wall that rises from the outer edge of the bottom wall. The eye-contacting portion is connected to an end of the peripheral wall opposite to the bottom wall side.

Eye-washing vessels of this type are usually designed to be removably attachable to the mouth part of a bottle that contains an eyewash solution. Such eye-washing vessels are typically distributed in the market in a state of being attached to the mouth part of a bottle.

CITATION LIST

Patent Document

Patent Document 1: Japanese Patent No. 4495807

SUMMARY

Technical Problem

When an eye-washing vessel, as disclosed in Patent Document 1, falls, for example, on the floor while being attached to the mouth part of a bottle containing an eyewash solution and while being in an orientation in which the eye-washing vessel is located below the bottle, the body of the vessel has a risk of being damaged due to an impact on the vessel. Furthermore, there is still room for improvement in the fit (close attachment) of the eye-contacting portion to a portion around the eye.

An object of the present invention is to provide an eye-washing vessel capable of preventing or reducing damage to the vessel body while also being capable of providing an improved fit of the eye-contacting portion of the vessel to a portion around the eye.

Solution to Problem

A possible solution to the above-described problem is to employ a relatively flexible material for the vessel body, while employing a further flexible material for the eye-contacting portion as compared to the material used for the vessel body. With this configuration, it is possible to prevent or reduce damage that would occur in the vessel body due to an impact load applied to the eye-washing vessel when, for example, the vessel falls on the floor, while at the same time also being possible to improve the fit of the eye-contacting portion to a portion around the eye.

In the above configuration, however, the material for the vessel body and the material for the eye-contacting portion are different from each other and, accordingly, there is a risk of the eye-contacting portion separating from the vessel body.

In view of the above, the present invention provides an eye-washing vessel for use in washing an eye with an eyewash solution, the vessel comprising: a vessel body capable of containing the eyewash solution; and an eye-contacting portion connected to the vessel body, wherein: the vessel body has a bottom wall and a peripheral wall which is shaped to rise from an outer edge of the bottom wall and which can be held with fingers; the eye-contacting portion is connected to an end of the peripheral wall opposite to the bottom wall side; the vessel body is made of a vessel-body material including polyethylene; and the eye-contacting portion is made of an eye-contacting portion material including polyethylene and a thermoplastic elastomer having a lower hardness than that of the polyethylene.

In the eye-washing vessel of the present invention, since the vessel-body material includes polyethylene, which is relatively flexible, the vessel prevents or reduces damage that would otherwise occur in the vessel body upon a fall, etc., of the eye-washing vessel. Furthermore, since the eye-contacting portion material includes polyethylene and a thermoplastic elastomer, the hardness of which is lower than the hardness of the polyethylene, the vessel provides an improved fit of the eye-contacting portion to a portion around the eye. Moreover, since the vessel-body material and the eye-contacting portion material both include polyethylene, the vessel body and the eye-contacting portion are strongly compatible to each other, and this prevents or reduces separation of the eye-contacting portion from the vessel body.

In the above, it is preferable for the vessel-body material to further include ethylene vinyl alcohol having a higher transparency than polyethylene.

With this embodiment, the vessel body has a higher transparency so that it becomes easier to see the eyewash solution inside the eye-washing vessel after washing the eye.

More specifically, the content of the ethylene vinyl alcohol in the vessel-body material is preferably 30% by weight or more and 70% by weight or less.

With this embodiment, the transparency of the vessel body can be ensured while avoiding a significant cost increase. To be more specific, a sufficient transparency of the vessel body is ensured when the content is 30% or more, and a significant cost increase is avoided when the content is 70% or less.

Furthermore, in the above-described eye-washing vessel, a hardness ratio, represented by the ratio of a hardness of the vessel body to a hardness of the eye-contacting portion, is preferably 1.075 or greater and 1.875 or smaller.

This embodiment can further surely prevent or reduce the damage to the vessel body upon a fall, etc., of the eye-washing vessel and achieve the improved fit of the eye-contacting portion to a portion around the eye. More specifically, when the hardness ratio is 1.875 or smaller, the flexibility of the vessel body can be ensured and this prevents or reduces the damage to the vessel body upon a fall, etc., of the eye-washing vessel. Meanwhile, when the hardness ratio is 1.075 or greater, the vessel body can retain its shape (when the peripheral wall is held and the eye-contacting portion is pressed against the portion around the eye, deformation of the peripheral wall or the vessel body is prevented or reduced), so that the fit of the eye-contacting portion to the portion around the eye can be effectively enhanced.

Advantageous Effects of Invention

As stated above, the present invention can provide an eye-washing vessel capable of preventing or reducing damage to the vessel body and also capable of providing an improved fit of the eye-contacting portion to a portion around the eye.

BRIEF DESCRIPTION OF DRAWINGS

FIG. 2 is a table showing materials used, hardness ratios, and various test results in Examples and Comparative Examples.

DESCRIPTION OF EMBODIMENTS

Figure 1:
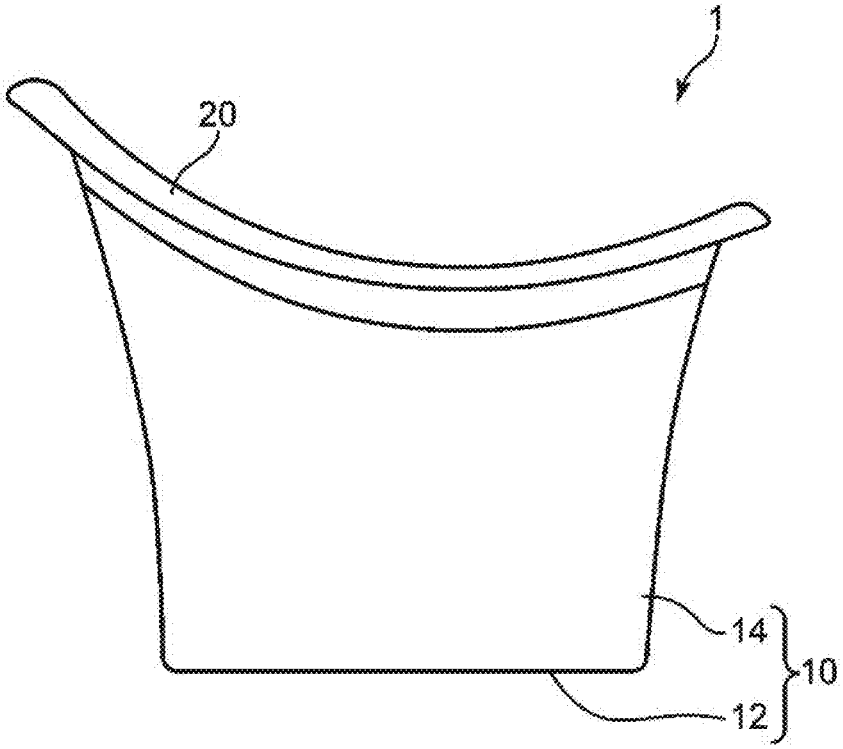
FIG. 1 is a front view of an eye-washing vessel according to an embodiment of the present invention.

An eye-washing vessel 1 according to an embodiment of the present invention will be described, with reference to FIG. 1. As illustrated in FIG. 1, the eye-washing vessel 1 has a vessel body 10 and an eye-contacting portion 20.

The vessel body 10 is a vessel that can contain an eyewash solution. Specifically, the vessel body 10 has a bottom wall 12 and a peripheral wall 14. The peripheral wall 14 is shaped to rise from the outer edge of the bottom wall 12. The peripheral wall 14 has rigidity that allows the wall to be held with fingers.

The eye-contacting portion 20 is connected to an end of the peripheral wall 14 opposite to the bottom wall 12 side (i.e., connected to the upper side in FIG. 1). The eye-contacting portion 20 has a shape that seamlessly continues to the peripheral wall 14 in the circumferential direction.

In the embodiment, the vessel body 10 is made of a material (hereinafter referred to as a "vessel-body material") including polyethylene (PE). Specifically, the vessel-body material includes polyethylene and ethylene vinyl alcohol (EVA) having a higher transparency than polyethylene. The polyethylene used may be low density polyethylene (LDPE), or may also be high density polyethylene (HDPE). The content of ethylene vinyl alcohol in the vessel-body material is preferably set at a value of 30% by weight or more and 70% by weight or less, and more preferably set at a value of 40% by weight or more and 60% by weight or less.

The eye-contacting portion 20 is made of a material (hereinafter referred to as an "eye-contacting portion material") including polyethylene and a thermoplastic elastomer having a smaller hardness than the hardness of the polyethylene. A styrene-based thermoplastic elastomer is preferably used for the thermoplastic elastomer. The hardness ratio that is represented by the ratio of the hardness of the vessel body 10 to the hardness of the eye-contacting portion 20 is preferably set at a value of 1.075 or greater and 1.875 or smaller.

As described above, the eye-washing vessel 1 of the embodiment is configured such that the vessel-body material includes polyethylene, which is relatively flexible, and this prevents or reduces damage that would occur to the vessel body 10 when, for example, the eye-washing vessel 1 falls. Furthermore, the eye-contacting portion material includes polyethylene and a thermoplastic elastomer whose hardness is lower than the hardness of the polyethylene, and this provides an improved fit of the eye-contacting portion 20 to a portion around the eye. Moreover, since the vessel-body material and the eye-contacting portion material both include polyethylene, the vessel body 10 and the eye-contacting portion 20 are strongly compatible to each other, and this prevents or reduces the separation of the eye-contacting portion 20 from the vessel body 10.

Furthermore, since the vessel-body material includes ethylene vinyl alcohol having a higher transparency than that of polyethylene, the transparency of the vessel body 10 increases as compared to the case where the vessel-body material includes polyethylene alone. Accordingly, it becomes easier to see the eyewash solution inside the eye-washing vessel 1 after washing the eyes.

Still further, the vessel-body material has an ethylene vinyl alcohol content of 30% by weight or more and 70% by weight or less, and this ensures a transparency of the vessel body 10 while avoiding a significant increase in cost. More specifically, a sufficient transparency of the vessel body 10 is ensured when the content is 30% or more, and a significant cost increase is avoided when the content is 70% or less.

Furthermore, the hardness ratio represented by the ratio of the hardness of the vessel body 10 to the hardness of the eye-contacting portion 20 is 1.075 or greater and 1.875 or smaller, and this can further ensure that the damage to the vessel body 10 upon a fall, etc., of the eye-washing vessel 1 is prevented or reduced and that the fit of the eye-contacting portion 20 to a portion around the eye is improved. More specifically, when the hardness ratio is 1.875 or smaller, the flexibility of the vessel body 10 is ensured so that the damage to the vessel body 10 upon a fall, etc., of the eye-washing vessel 1 is prevented or reduced. Meanwhile, when the hardness ratio is 1.075 or greater, the retention of the shape of the vessel body 10 is ensured (when the peripheral wall 14 is held and the eye-contacting portion 20 is pressed against the portion around the eye, deformation of the peripheral wall 14 or the vessel body 10 is prevented or reduced), so that the fit of the eye-contacting portion 20 to the portion around the eye can be effectively enhanced.

It should be appreciated that the embodiments disclosed herein are illustrative, but not restrictive, in every aspect. The scope of the present invention is defined by the scope of the claims, rather than by the above description of the embodiments, and includes all modifications that fall within the meaning and range of the claims and equivalents thereof.

EXAMPLES

Examples of the eye-washing vessel 1 of the embodiment will now be described, together with Comparative Examples. Specifically, four Examples of the eye-washing vessel 1 of the embodiment were prepared, along with three Comparative Examples for such Examples. The vessel-body material and eye-contacting portion material used in each of the Examples and Comparative Examples are as shown in FIG. 2. In FIG. 2, the field of the vessel-body material in Examples 3 and 4 indicates the mixture ratio (weight ratio) of low density polyethylene (LDPE) and ethylene vinyl alcohol (EVA). Furthermore, "Material A" mentioned in the field of the eye-contacting portion material means a material including polyethylene, process oil and a styrene-based thermoplastic elastomer, and it specifically means "EARNESTON JC50N" produced by Kuraray Plastics Co., Ltd. Further, "Material B" mentioned in the field of the eye-contacting portion material means a material including polypropylene, process oil and a styrene-based thermoplastic elastomer, and it specifically means "ARONKASEI AR850C" produced by Aronkasei Co., Ltd.

FIG. 2 also shows the hardness ratio (which is an index represented by the ratio of the hardness of the vessel body 10 to the hardness of the eye-contacting portion 20). The hardness ratio was calculated based on the Shore A hardness of each material. The Shore A hardness of the materials is as follows: low density polyethylene has a Shore A hardness of 45; high density polyethylene has a Shore A hardness of 75; ethylene vinyl alcohol has a Shore A hardness of 40; polypropylene (PP) has a Shore A hardness of 110; Material A has a Shore A hardness of 40; and Material B has a Shore A hardness of 40. The above hardness of each material is determined in accordance with JIS K 6253. The hardness ratio in Examples 3 and 4 was calculated based on the Shore A hardness of low density polyethylene, the Shore A hardness of Material A, and the mixture ratio of low density polyethylene and ethylene vinyl alcohol.

FIG. 2 also shows the results of three tests—(1) falling test, (2) adhesion, and (3) vessel body transparency—performed for each of the Examples and Comparative Examples. The methods and results of the tests will be described below.

(1) Falling Test

The eye-washing vessel was connected to the mouth of a (500 mL) bottle containing an eyewash solution, and the eye-washing vessel and the bottle were fixed in this state with a shrink film and then left to stand at 5° C. for 24 hours. After that, the bottle and the eye-washing vessel were allowed to fall on a concrete floor from a height of 1.3 m, in an orientation in which the eye-washing vessel was located below the bottle. This falling test was carried out for ten sets of the bottles and eye-washing vessels, to observe whether each eye-washing vessel had a break. It should be noted here that, if an eye-washing vessel had a crack, such vessel was regarded as having a break. The symbols shown in FIG. 2 indicate the following criteria.

○: None of the ten sets had a break.

×: A break occurred in at least one set.

As can be seen from FIG. 2, when the vessel-body material included polyethylene, a test result evaluated as ○ was obtained; whereas, when the vessel-body material included polypropylene, a test result evaluated as × was obtained. Further, when the hardness ratio was 1.075 or greater and 1.875 or smaller, a test result evaluated as ○ was also obtained. These results show that it is effective to include relatively flexible polyethylene in the vessel-body material in order to prevent or reduce damage to the vessel body 10, and that a hardness ratio set within the aforementioned range is also effective for achieving such prevention or reduction.

(2) Adhesion

A test piece (3 cm) was cut out from the eye-washing vessel so that the test piece included the boundary portion between the eye-contacting portion and the peripheral wall. A tensile test was performed for the prepared test piece using a tensile test machine. The tensile test machine used was AGS-500D manufactured by Shimadzu Corporation and the tensile force was set to 200 N. The symbols shown in FIG. 2 indicate the following criteria.

○: No separation of the eye-contacting portion from the vessel body occurred.

×: A separation of the eye-contacting portion from the vessel body occurred.

As can be seen from FIG. 2, when both the vessel-body material and the eye-contacting portion material included the same type of resin (i.e. when each of the vessel-body material and the eye-contacting portion material included polyethylene, or when each of the vessel-body material and the eye-contacting portion material included polypropylene), a test result evaluated as ○ was obtained. On the other hand, when the vessel-body material and the eye-contacting portion material did not include the same type of resin, a test result evaluated as × was obtained. These results and the results in (1) above show that it is preferable for both the vessel-body material and the eye-contacting portion material to include polyethylene.

(3) Vessel Body Transparency

An eyewash solution was put in the eye-washing vessel. In that state, the eyewash solution inside the vessel body was visually observed via the bottom wall and the peripheral wall. The symbols shown in FIG. 2 indicate the following criteria.

◎: Transparent (the amount of the eyewash solution was clearly visible)

○: Semi-transparent (the amount of the eyewash solution was almost visible)

Δ: Semi-transparent (the amount of the eyewash solution was partly visible)

×: Non-transparent (the amount of the eyewash solution was difficult to see)

The results of each of the Examples shown in FIG. 2 demonstrate that the transparency of the vessel body 10 increases with an increase in the content of EVA in the vessel-body material. Furthermore, when considering the results of the above three tests together, Example 4 is regarded as being the most preferable example. In addition, even when the content of ethylene vinyl alcohol in the vessel body 10 of Example 4 was varied to 40% by weight and 60% by weight, similar results to those in Example 4 were obtained.

REFERENCE SIGNS LIST

1 Eye-washing vessel
10 Vessel body
12 Bottom wall
14 Peripheral wall
20 Eye-contacting portion

What is claimed is:

1. An eye-washing vessel for use in washing an eye with an eyewash solution, the vessel comprising:

a vessel body capable of containing the eyewash solution; and an eye-contacting portion connected to the vessel body, wherein:

the vessel body has a bottom wall, and a peripheral wall which is shaped to rise from an outer edge of the bottom wall and can be held with fingers;

the eye-contacting portion is connected to an end of the peripheral wall opposite to the bottom wall side;

the vessel body is made of a vessel-body material including polyethylene; and the eye-contacting portion is made of an eye-contacting portion material including polyethylene and a thermoplastic elastomer having a lower hardness than a hardness of the polyethylene.

2. The eye-washing vessel according to claim 1, wherein the vessel-body material further includes ethylene vinyl alcohol having a higher transparency than a transparency of polyethylene.

3. The eye-washing vessel according to claim 2, wherein a content of the ethylene vinyl alcohol in the vessel-body material is 30% by weight or more and 70% by weight or less.

4. The eye-washing vessel according to claim 1, wherein a hardness ratio, represented by a ratio of a hardness of the vessel body to a hardness of the eye-contacting portion, is 1.075 or greater and 1.875 or smaller.

* * * * *